US009820071B2

(12) United States Patent
Blamey

(10) Patent No.: US 9,820,071 B2
(45) Date of Patent: Nov. 14, 2017

(54) SYSTEM AND METHOD FOR BINAURAL NOISE REDUCTION IN A SOUND PROCESSING DEVICE

(75) Inventor: Peter Blamey, South Yarra (AU)

(73) Assignee: Blamey & Saunders Hearing Pty Ltd., Victoria (AU)

( * ) Notice: Subject to any disclaimer, the term of this patent is extended or adjusted under 35 U.S.C. 154(b) by 756 days.

(21) Appl. No.: 13/061,024

(22) PCT Filed: Aug. 27, 2009

(86) PCT No.: PCT/AU2009/001104
§ 371 (c)(1),
(2), (4) Date: Oct. 18, 2011

(87) PCT Pub. No.: WO2010/022456
PCT Pub. Date: Mar. 4, 2010

(65) Prior Publication Data

US 2012/0128164 A1 May 24, 2012

(30) Foreign Application Priority Data

Aug. 31, 2008 (AU) ..... 2008904473

(51) Int. Cl.
*H04R 25/00* (2006.01)
*H04S 1/00* (2006.01)
*H04R 5/04* (2006.01)

(52) U.S. Cl.
CPC ..... *H04S 1/002* (2013.01); *H04R 5/04* (2013.01); *H04R 25/407* (2013.01); *H04R 25/552* (2013.01)

(58) Field of Classification Search
None
See application file for complete search history.

(56) References Cited

U.S. PATENT DOCUMENTS 3,894,196 A 7/1975 Briskey
5,029,217 A 7/1991 Chabries et al.
(Continued)

FOREIGN PATENT DOCUMENTS

WO WO2007063139 A2 * 6/2007
WO 2007/095664 A1 8/2007

OTHER PUBLICATIONS

Boll, Steven F. "Suppression of Acoustic Noise in Speech Using Spectral Subtraction." IEEE 27.2 (1979): 113-20. Web. Mar. 18, 2014.*

(Continued)

*Primary Examiner* — Joseph Saunders, Jr.
*Assistant Examiner* — James Mooney
(74) *Attorney, Agent, or Firm* — KPPB LLP

(57) ABSTRACT

In one embodiment, the present invention provides a sound processing device with a binaural input and binaural output, where "binaural input" means at least one microphone mounted in or near each ear of the device user, and "binaural output" means at least one output signal directed to each ear. The device may be comprised of two parts connected by a wired or wireless link. The device comprises: at least one microphone in or near each ear for the transduction of the sound at each ear; a signal-to-noise estimation module to estimate the signal-to-noise ratio present at each ear; a comparison and selection module to compare the signal-to-noise ratios present at the two ears and select the ear with the greater signal-to-noise ratio; a noise reduction control module that uses the spectral and temporal information from the selected ear signal to control two identical noise reduction modules; two identical noise reduction modules that process the signals from the two ears, under the control of the control module; and two output modules that amplify the output signals from the noise reduction modules appropriately for (Continued)

each ear and present the amplified signals as sound or other signals to each ear of the device user. The device may be implemented in dedicated hardware embodiment or by software running on a microprocessor.

19 Claims, 2 Drawing Sheets

(56) References Cited

U.S. PATENT DOCUMENTS

| | | | | |
|---|---|---|---|---|
| 5,479,522 | A * | 12/1995 | Lindemann et al. | 381/23.1 |
| 5,651,071 | A | 7/1997 | Lindemann et al. | |
| 6,222,927 | B1 | 4/2001 | Feng et al. | |
| 6,731,767 | B1 | 5/2004 | Blamey et al. | |
| 2003/0220786 | A1* | 11/2003 | Chandran et al. | 704/205 |
| 2004/0196994 | A1 | 10/2004 | Kates | |
| 2006/0126865 | A1* | 6/2006 | Blamey et al. | 381/102 |
| 2006/0227976 | A1* | 10/2006 | Csermak et al. | 381/1 |
| 2007/0021085 | A1* | 1/2007 | Kroeger | H04B 7/086 455/272 |
| 2007/0098202 | A1* | 5/2007 | Viranyi et al. | 381/380 |
| 2007/0291969 | A1* | 12/2007 | Tateno et al. | 381/315 |
| 2008/0089530 | A1* | 4/2008 | Bostick | H03G 3/32 381/74 |
| 2008/0279410 | A1* | 11/2008 | Cheung et al. | 381/381 |
| 2009/0028363 | A1* | 1/2009 | Frohlich et al. | 381/309 |

OTHER PUBLICATIONS

Bregman, A.S., "Auditory Scene Analysis: The Perceptual Organization of Sound", MIT Press, Cambridge Massachusetts, 1990, pp. 9-11.

Dillion, H., "Hearing Aids", Boomerang Press, 2001, Chapter 6 "Compression Systems in Hearing Aids", pp. 159-186.

Dillion, H., "Hearing Aids", Boomerang Press, 2001, Section 9.3 "Gain, Frequency Response, and Input-Output Functions for Nonlinear Amplification", pp. 249-262.

Dillion, H., "Hearing Aids", Boomerang Press, 2001, Chapter 14 "Binaural and Bilateral Considerations in Hearing Aid Fitting", pp. 370-403.

International Search Report for International Application No. PCT/AU2009/001104, International Filing Date Aug. 27, 2009, Search Completed dated Nov. 24, 2009, dated Nov. 27, 2009, 4 pages.

International Written Opinion for International Application No. PCT/AU2009/001104, International Filing Date Aug. 27, 2009, Report Completed dated Nov. 24, 2009, dated Nov. 27, 2009, 3 pages.

P.J. Blamey, "Adaptive Dynamic Range Optimization for Hearing Aids", The 9th Western Pacific Acoustics Conference, Seoul, Korea, Jun. 26-28, 2006.

P.J. Blamey et al., "An Intrinsically Digital Amplification Scheme for Hearing Aids", J. App. Sig. Proc. 18, 2005, pp. 3026-3033.

* cited by examiner

Figure 1. Pair of devices with binaural noise reduction
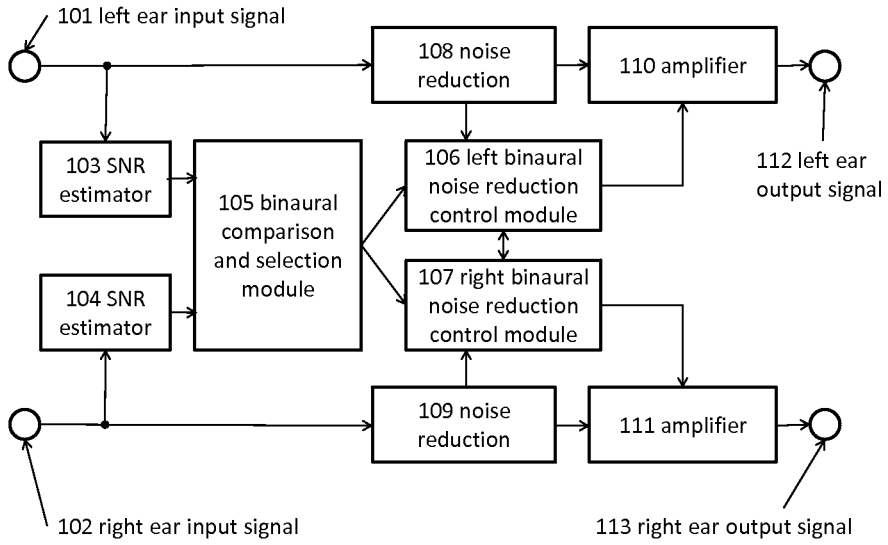
Figure 2. Signal-to-Noise Estimator
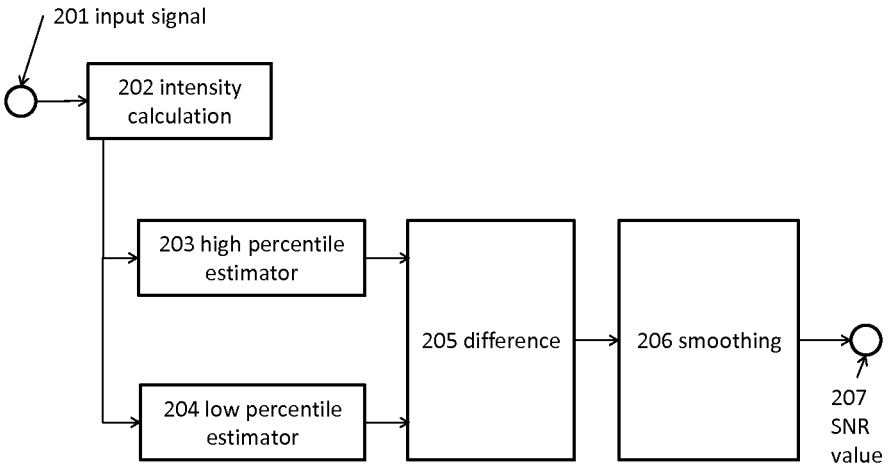

Figure 3. Binaural comparison and selection module
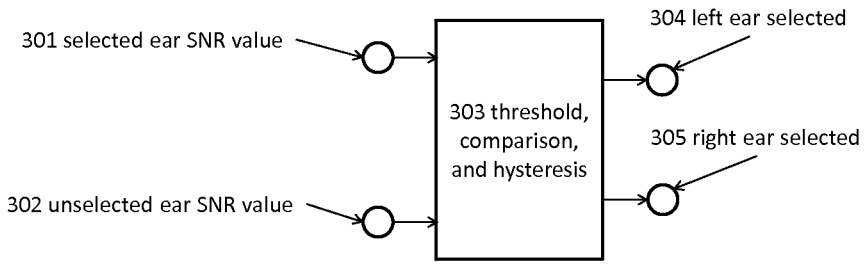
Figure 4. Binaural noise reduction control module
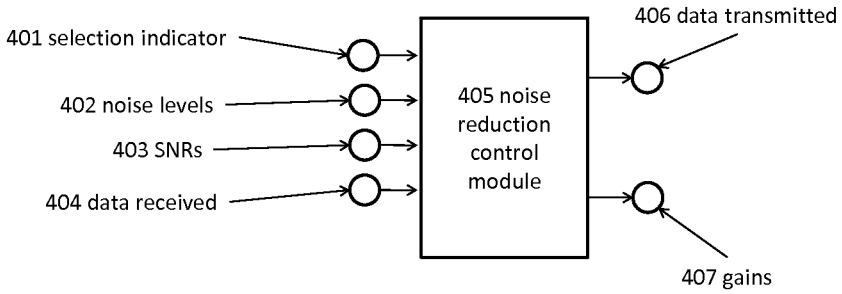

SYSTEM AND METHOD FOR BINAURAL NOISE REDUCTION IN A SOUND PROCESSING DEVICE

FIELD OF THE INVENTION

The present invention relates to sound processing devices in which an acoustic sound input or an electric or digital representation of an acoustic sound input is processed and converted to an acoustic or electric sound output, and in particular relates to the processing of sound in noisy environments to improve speech intelligibility, sound quality, and naturalness of the sound. Sound processing devices of this kind are often used in hearing aids, assistive listening devices (ALD), and consumer audio devices such as radios, television sets, CD players, MP3 players, stereo systems, headsets, telephones, and mobile phone handsets. The Global Medical Device Nomenclature Agency (GMDNS) definition of an ALD is an amplifying device, other than a hearing aid, for use by a hard of hearing person. In the case of an electric sound output, sound processing devices of this kind are used in cochlear implants.

BACKGROUND OF THE INVENTION

Sound processing devices, including hearing aids, ALDs, cochlear implants, and consumer audio devices are being used more frequently in noisy environments. Normally, people make good use of both ears to separate the sounds they want to listen to from the other noises in the environment that they want to ignore. Present day consumer audio devices, hearing aids, cochlear implants, and ALDs also rely on these internal binaural perceptual processes to be able to function adequately in noisy environments. In addition to the internal perceptual processing, many audio devices include various external noise reduction schemes aimed at improving speech intelligibility, sound quality, and listening comfort in noisy environments. These noise reduction schemes typically use information that is available from a single microphone, or an array of closely-spaced microphones that may be worn on one side of the head. They rely on directional information, and spectral and temporal information to separate desired sounds from other noises in the environment. For example, some schemes seek to improve signal-to-noise ratios by expanding the intensity differences between more intense parts of the sound and less intense parts of the sound. A noise reduction scheme based on spectral information may apply more gain to the peaks in the spectrum than to the troughs. A noise reduction scheme based on temporal information may apply more gain at times when the sound is above a certain intensity threshold than when the sound is below this threshold. A noise reduction scheme based on directional information may apply more gain to sounds from the front of the listener than sounds from other directions. There is clear evidence that directional microphones can improve sound quality, comfort, and intelligibility. It is also clear that spectral and temporal noise reduction improves comfort, but the effects of spectral and temporal noise reduction on intelligibility and sound quality are more controversial.

One potential reason for the uncertainty about the effects of external spectral and temporal noise reduction schemes on intelligibility and sound quality is that they are changing the spectral and temporal cues that are used by the internal perceptual processes. If these cues are changed differently in the left and right ears, they may also disrupt the internal binaural processes that most listeners rely upon most heavily in noisy situations. There are at least three important perceptual processes that are important in binaural sound perception:

a) Integration of information from both ears. This includes integration of information about both the desired sounds and the other noises in the environment.
b) The ability to separate sounds from different sources and to pay attention to the sounds from one ear or the other when it is advantageous to do so.
c) The ability to use small timing and intensity differences between the ears.

Bregman (1990) uses the term "auditory streaming" to describe the perceptual process that separates sounds from different sources and groups together sounds from the same source. A stream is a series of sequential and overlapping sound events that come from the same source. An example of a stream is the speech from a single person speaking. A word or a sentence spoken by this person must be perceived as a connected series of sound events to be understood, while being kept separate from the other sounds in the environment. Important sound events include the onsets and offsets of sounds, and changes in intensity and spectrum. The spectral and temporal noise reduction schemes referred to above introduce onsets and offsets, changes in intensity, and spectral changes in the noise that are correlated with the onsets and offsets and spectral changes in the desired signals. The perceptual effects of introducing these artificial streaming cues are difficult to predict. On one hand, they may emphasize the temporal and spectral characteristics of the desired sounds. On the other hand they will make it more difficult for the internal auditory streaming processes to separate the desired sound events and streams from the noise events and streams.

Any discussion of documents, acts, materials, devices, articles or the like which has been included in the present specification is solely for the purpose of providing a context for the present invention. It is not to be taken as an admission that any or all of these matters form part of the prior art base or were common knowledge in the field relevant to the present invention as it existed before the priority date of each claim of this application.

SUMMARY OF THE INVENTION

According to a first aspect the present invention provides a method for controlling a sound processing device having a binaural input including at least one microphone mounted in or near each ear of the device user, and having a binaural output including at least one output signal directed to each ear including: transducing sound at each ear, by the respective at least one microphone in or near the ear; estimating a signal-to-noise ratio present at each ear; selecting the ear with the greater signal-to-noise ratio; applying noise reduction processing to the signals of each ear based on information present in the signal of the selected ear; and presenting the processed signals to each ear.

According to a second aspect the present invention provides a sound processing device having a binaural input including at least one microphone mounted in or near each ear of the device user, and having a binaural output including at least one output signal directed to each ear, the device including: at least one microphone in or near each ear for the transduction of sound at each ear; a signal-to-noise estimation module to estimate the signal-to-noise ratio present at each ear; a comparison and selection module to compare the signal-to-noise ratios present at the two ears and to select the ear with the greater signal-to-noise ratio; a noise reduction control module that uses information present in the signal of the selected ear to control two noise reduction modules; two noise reduction modules that process the respective signals of the two ears, under the control of the control module; and two output modules that present the signals to each ear of the device user.

According to a third aspect the present invention provides a computer program product comprising computer program code means to make a computer execute a binaural noise reduction sound processing procedure, the computer program product including: computer program means accepting at least one input signal representing sound from at or near each ear of a listener; computer program means for estimating a signal-to-noise ratio present at each ear; computer program means for comparing the signal-to-noise ratios present at the two ears and selecting the ear with the greater signal-to-noise ratio; computer program means for using information from the signal of the selected ear to control two noise reduction processes respectively applied to the signals from the two ears; and computer program means for presenting the signals to each ear of the device user.

It is to be understood that "presenting signals to the ear" within the scope of this invention can include one or more of: generating acoustic signals to be presented to the outer ear by a speaker; generating electrical stimuli to be presented to the cochlea by a cochlear implant, generating mechanical signals for bone conduction to the middle ear, or the like.

The present invention recognises that if artificial streaming cues created by signal processing applied for external noise reduction are different in the two ears, they will add further to the confusion between what is the desired sound stream and what is the noise stream. The present invention thus recognises that it is important that the external noise reduction processing operates in a coordinated and consistent manner in the two ears.

In addition to avoiding the creation of artificial events or streaming cues, and avoiding the creation of artificial differences between the ears, the present invention recognises that an effective binaural sound processing strategy also needs to be able to "pay attention to only one ear when it is advantageous to do so." This invention can thus be considered to offer a prosthetic supplement or substitute to the perceptual ability of normal human hearing mentioned at point (b) in the preceding. In order to emulate this aspect of the internal binaural processing, a binaural sound processing device needs to continuously assess the signal-to-noise ratio in each ear, select the ear with the higher signal-to-noise ratio, and use the signal at that ear as a basis for controlling the noise reduction processing for both ears.

The amplifier for each ear preferably comprises a conventional wide dynamic range compression (WDRC) or adaptive dynamic range optimization (ADRO) sound amplifier. See Dillon 2001 for a review of the WDRC prior art. See Blamey et al, U.S. Pat. No. 6,731,767 for a description of the ADRO sound processing. The variable gain in each channel of the amplifier may also be controlled according to the information derived from the ear with the greater signal-to-noise ratio, and the overall gain of the ear with the lower signal-to-noise ratio may be reduced relative to the overall gain of the ear with the higher signal-to-noise ratio.

In one embodiment of the invention, the noise reduction scheme is a multichannel expansion scheme or spectral subtraction scheme which temporarily reduces the gain applied to frequency bands that are thought to be primarily noise, and increases the gain in frequency bands that are thought to be primarily signal. The choice between whether a frequency band contains primarily noise or signal is preferably based on instantaneous amplitude and dynamic range of the sound in that frequency band in the selected ear. The reduction or increase in gain is applied equally and simultaneously to the signal for both ears. The control signals derived from the selected ear signal can be particularly simple in this case, for example, a 32-channel noise reduction scheme can be controlled by sending 32 bits to encode whether each channel is primarily signal (bit value=1) or noise (bit value=0).

In a second embodiment of the invention, the gains or gain reductions for each frequency channel are transmitted from the selected ear to the unselected ear and applied simultaneously to the signal for each ear.

In a third embodiment of the invention, the amplitude and dynamic range (or signal-to-noise ratio) for each frequency band are transmitted from the selected ear to the unselected ear and applied in identical noise reduction algorithms in both ears simultaneously.

The changes to the gains in individual frequency channels of the noise reduction processing or in the individual frequency channels of the amplifiers are preferably made slowly enough and over a time scale that is long enough to avoid the generation of artificial sound events and streaming cues. Any faster changes that may be necessary to avoid discomfort or damage to hearing are preferably applied across a broad frequency range and are also applied identically and simultaneously to each ear.

The operation of controls on the device, such as a volume control and program selection switch are preferably linked so that any change initiated by the control is applied to both ears simultaneously in a coordinated manner.

The sound processing in the two signal paths for the two ears is preferably configured to have minimum delay (Dickson and Steele, 2006) and to have equal delay from input to output to preserve fine temporal differences between the ears to the maximum extent possible.

The wired or wireless communication link between the two devices is preferably disabled when the signal-to-noise-ratio in each ear is greater than a configurable threshold value, and enabled when the signal-to-noise-ratio is below the configurable threshold. The purpose of this refinement is to save power when binaural noise reduction is not required or would not provide any discernable improvement to sound quality or speech intelligibility.

BRIEF DESCRIPTION OF THE DRAWINGS

FIG. 1 illustrates a block diagram for one embodiment of the binaural noise reduction sound processor.

FIG. 2 illustrates a preferred method of estimating signal-to-noise ratio.

FIG. 3 illustrates a preferred method of comparing signal-to-noise ratio for the two ears and selecting the ear with the better signal-to-noise ratio.

FIG. 4 illustrates a preferred method of controlling the operation of the noise reduction modules.

DESCRIPTION OF THE PREFERRED EMBODIMENTS

FIG. 1 illustrates an example architecture for a pair of devices with sound signal processing incorporating the invention for binaural noise reduction. One or more input signals for the left ear 101 are passed to the left ear signal-to-noise ratio estimator 103 and the left ear noise reduction module 108. The input signals are usually provided by one or more microphones situated in or close to the left ear. Similarly, one or more input signals for the right ear 102 are passed to the right ear signal-to-noise ratio estimator 104 and the right ear noise reduction module 109. The input signals are usually provided by one or more microphones situated in or close to the right ear. The signal-to-noise ratio estimators 103 and 104 estimate the signal-to-noise ratios in the left ear and right ear signals respectively and pass on the estimated signal-to-noise ratios to the binaural comparison and selection module 105. The binaural comparison and selection module 105 may be located in either the left or right ear device, with communication to the other ear by wired or wireless connections. The binaural comparison and selection module compares the two signal-to-noise ratios and selects the ear with greater signal-to-noise ratio. The choice is based on smoothed signal-to-noise ratio data, and hysteresis is applied to avoid excessive or random changes in the selected ear when the signal-to-noise ratio estimates for the two ears are similar. The selected ear indicator is passed to the binaural noise reduction control modules 106 and 107. The noise reduction modules 108 and 109 continuously monitor one or more frequency bands to determine whether the sound in each frequency band is predominantly signal or noise. The signal-or-noise indicators for each band are passed to the binaural noise reduction control modules 106 and 107 respectively. The noise reduction control module for the selected ear returns a set of signal-or-noise indicators to the noise control module for the unselected ear. If the selected ear is the left ear, then the signal-or-noise indicators for the left ear are returned to both amplifier modules 110 and 111. If the selected ear is the right ear, then the signal-or-noise indicators for the right ear are returned to both amplifier modules 110 and 111. The amplifier modules increase or decrease the gains in each frequency band according to the signal-or-noise indicators returned from the binaural noise reduction control module. The processed signal for the left ear is passed from the noise reduction module 108 to the amplifier 110 and thence to the output 112. Similarly, the processed signal for the right ear is passed from the noise reduction module 109 to the amplifier 111 and thence to the output 113. Optionally, the overall gain for the selected ear may be increased by a small amount and the overall gain for the non-selected ear may be decreased by a small amount. Optionally, the noise reduction module in the unselected ear, and the wireless link (if any) from the noise reduction module in the unselected ear, may be turned off to reduce power consumption in the unselected device.

FIG. 2 illustrates a preferred method of estimating the signal-to-noise-ratio for the left ear signal or right ear signal. The intensity calculation module 202 operates by squaring the amplitude of the input signal 201 and taking the logarithm of the squared input signal to give the intensity in decibels (dB). The intensity value is fed to the high percentile estimator 203 and the low percentile estimator 204. Each percentile estimator maintains a "percentile value" which is updated at regular intervals. The intensity value is compared with the percentile value. If the intensity value is greater than the percentile value, the percentile value is incremented by a small fixed amount, the UP STEP. If the intensity value is less than the percentile value, the percentile value is decremented by a small fixed amount, the DOWN STEP. If the ratio of the UP STEP to the DOWN step is 9:1 then the percentile value will tend towards an intensity value at the upper end of the intensity range that is exceeded 10% of the time (9 smaller DOWN STEPS will be balanced by one larger UP STEP). Similarly, if the ratio of the UP STEP to the DOWN STEP is 3:7 then the percentile value will tend towards an intensity value at the lower end of the range that is exceeded 70% of the time (3 larger DOWN STEPS will be balanced by 7 smaller UP STEPS). Other percentages may be selected for the high and low percentile estimators provided that the ratio of the UP STEP to the DOWN STEP is greater for the high percentile estimator than the low percentile estimator. Assuming that the peaks at the upper end of the intensity range are a measure of the signal level and the valleys at the lower end of the intensity range are a measure of the noise level, then the difference 205 between the high percentile value and the low percentile value provides a measure related to the signal to noise ratio (SNR). The difference value is smoothed by module 206 to reduce random variations in the SNR estimates.

FIG. 3 illustrates a preferred method of comparing signal-to-noise ratio for the two ears and selecting the ear with the better signal-to-noise ratio. The smoothed SNR value for the selected ear 301 is compared with the smoothed SNR value for the unselected ear 302 in the threshold, comparison and hysteresis module 303. If the SNR value for the unselected ear is greater than the SNR value for the selected ear plus a fixed amount, Delta, then the unselected ear becomes the selected ear, otherwise, the selected ear remains unchanged. Delta is a small positive amount (1 dB for example) that introduces some hysteresis into the selection of the ear in order to avoid rapid switching if the SNR is similar in the two ears. If the SNR for both ears is greater than a fixed Threshold value (10 dB for example), then neither ear is selected and the binaural noise reduction is switched off to save power.

FIG. 4 illustrates the operation of the binaural noise reduction control modules. A conventional (monaural) noise reduction scheme typically operates by reducing the gain in each frequency channel as the noise level goes up and/or the signal-to-noise ratio goes down. The binaural noise reduction scheme operates in an analogous manner except that the gain reduction is related to the noise level and/or signal-to-noise ratio in the frequency channels of the selected ear. This is achieved by passing information from the selected ear to the unselected ear. In the selected ear, the noise level 402 and the signal-to-noise-ratio 403 for each frequency channel are used to calculate the gain reduction 407 that is passed to the amplifier. Data 406 is also transmitted to the unselected ear. The information passed 406 may include the noise level 402, the signal-to-noise ratio 403, and the gain 407 values for each frequency channel in the selected ear. The choice of information to be transmitted from the selected ear to the unselected ear is optimally made to minimise the power expended in transmitting the information. In the unselected ear, the incoming data received 404 is used to calculate the gains 407 that are passed to the amplifier.

Many alternative noise reduction algorithms may be adapted for use in the binaural noise reduction scheme the subject of this invention. In one embodiment of the invention, the noise reduction scheme is a multichannel scheme which temporarily reduces the gain applied to frequency channels that are thought to be primarily noise, and increases the gain in frequency channels that are thought to be primarily signal. The choice between whether a frequency channel contains primarily noise or signal is preferably based on instantaneous amplitude 402 and signal-to-noise ratios 403 of the sound in that frequency channel in the selected ear. In a preferred embodiment of this type, the $30^{th}$ and $90^{th}$ percentiles of the amplitude are calculated in each frequency channel. If the amplitude is below the $30^{th}$ percentile, or the $90^{th}$ percentile is less than 2 dB above the $30^{th}$ percentile, the frequency channel is judged to contain mostly noise, otherwise the frequency channel is judged to contain primarily signal. The reduction in gain for channels that are primarily noise and increase in gain for frequency channels that are mostly signal are applied equally and simultaneously to the signal for both ears. The control signals derived from the selected ear signal can be particularly simple in this case, for example, a 32-channel noise reduction scheme can be controlled by sending 32 bits to encode whether each channel is primarily signal (bit value=1) or noise (bit value=0). Preferably, a maximum cumulative gain reduction and a maximum cumulative gain increase are applied in each frequency channel.

In a second embodiment of the invention, the gains or gain reductions for each frequency channel are calculated in the selected ear in the same manner as for a conventional monaural noise reduction scheme and transmitted from the selected ear to the unselected ear and applied simultaneously to the signal for each ear.

In a third embodiment of the invention, the amplitude and dynamic range (or signal-to-noise ratio) for each frequency band are transmitted from the selected ear to the unselected ear and applied in identical noise reduction algorithms in both ears simultaneously.

The advantages of these embodiments of the present invention comprise: more accurate assessment of signal and noise levels in the unselected ear by utilizing information from the ear with the better SNR; avoidance of the creation of artificial streaming events that could disrupt the normal binaural processing of sounds; emphasize the signal relative to the noise in such a manner as to improve the signal-to-noise ratio in the unselected ear; minimizing the data transmission requirements and hence minimizing the additional power consumption of the devices; intelligently switching data transmission from one ear to the other to halve power consumption relative to a device that always transmits data in both directions; and intelligently switching off data transmission when binaural noise reduction is not required to reduce battery consumption.

Some portions of this detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent series of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

As such, it will be understood that such acts and operations, which are at times referred to as being computer-executed, include the manipulation by the processing unit of the computer of electrical signals representing data in a structured form. This manipulation transforms the data or maintains it at locations in the memory system of the computer, which reconfigures or otherwise alters the operation of the computer in a manner well understood by those skilled in the art. The data structures where data are maintained are physical locations of the memory that have particular properties defined by the format of the data. However, while the invention is described in the foregoing context, it is not meant to be limiting as those of skill in the art will appreciate that various of the acts and operations described may also be implemented in hardware.

It should be borne in mind, however, that all of these and similar terms are to be associated with the appropriate physical quantities and are merely convenient labels applied to these quantities. Unless specifically stated otherwise as apparent from the description, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A method for controlling a sound processing device having a binaural input comprising at least one microphone mounted in or near each ear of the device user, and having a binaural output comprising at least one output signal directed to each ear, the method comprising:

transducing sound at each ear, by the respective at least one microphone in or near the ear, to produce a respective signal comprising a digital representation of the sound at each ear;

estimating from the digital representation of the sound at each ear a signal-to-noise ratio present in the digital representation of the sound at each ear;

selecting the ear with the greater signal-to-noise ratio;

applying noise reduction processing to improve a signal to noise ratio of the digital representation of the sound of each ear using at least one noise reduction parameter which is determined based only on information present in the signal of the selected ear, whereby the at least one noise reduction parameter is used as a basis for controlling the noise reduction processing to operate consistently in each ear; and presenting the processed signals to each ear.

2. A method according to claim 1, further comprising amplifying each signal after the noise reduction processing.

3. The method according to claim 1, wherein selecting the ear with the greater signal-to-noise ratio is subject to smoothing and hysteresis, and wherein the at least one noise reduction parameter is determined continuously.

4. A sound processing device having a binaural input comprising at least one microphone mounted in or near each ear of the device user, and having a binaural output comprising at least one output signal directed to each ear, the device comprising:

at least one microphone in or near each ear for the transduction of sound at each ear, to produce a respective signal comprising a digital representation of the sound at each ear;

a signal-to-noise estimation module to estimate from the digital representation of the sound at each ear a signal-to-noise ratio present in the digital representation of the sound at each ear;

a comparison and selection module to compare the signal-to-noise ratios present at the two ears and to select the ear with the greater signal-to-noise ratio;

a noise reduction control module that uses information present in the signal of the selected ear to control two noise reduction modules;

two noise reduction modules that process the respective digital representations of the sound of the two ears to improve the signal to noise ratio of the digital representations, using at least one noise reduction parameter which is determined based only on information present in the signal of the selected ear, under the control of the control module, whereby the information present in the signal of the selected ear is used as a basis for controlling the noise reduction processing to operate consistently in each ear; and two output modules that present the signals to each ear of the device user.

5. The sound processing device of claim 4 in which the output modules comprise wide dynamic range compression (WDRC) amplifiers with at least one frequency channel.

6. The sound processing device of claim 5 in which the variable gain in each channel of each WDRC amplifier is controlled according to the amplitude information derived from the selected ear with the greater signal-to-noise ratio.

7. The sound processing device of claim 4 in which the output modules comprise Adaptive Dynamic Range Optimisation (ADRO) amplifiers with at least one frequency channel.

8. The sound processing device of claim 7 in which the variable gain in each channel of each ADRO amplifier is controlled according to the amplitude and percentile information derived from the selected ear with the greater signal-to-noise ratio.

9. The sound processing device of claim 4 in which the noise reduction modules use multichannel expansion or spectral subtraction to reduce the gain applied to frequency bands that are determined to be primarily noise, and to increase the gain in frequency bands that are determined to be primarily signal; the choice between whether a frequency band contains primarily noise or signal being based on the instantaneous amplitude and dynamic range of the sound in that frequency band in the selected ear; and wherein the reduction or increase in gain is applied substantially equally and simultaneously to the signal for both ears.

10. The sound processing device of claim 9 in which the control signals derived from the selected ear signal consist of a single bit to encode whether each channel is primarily signal or noise.

11. The sound processing device of claim 4 in which gains or gain reductions are determined for each frequency channel and are transmitted from the selected ear noise reduction control module or output module to the unselected ear noise reduction control module or output module and applied substantially simultaneously to the signal for each ear.

12. The sound processing device of claim 4 in which the amplitude and dynamic range or signal-to-noise ratio for each frequency band are transmitted from the selected ear noise reduction control module and/or output module to the unselected ear noise reduction control module or output module and applied in both ears substantially simultaneously.

13. The sound processing device of claim 4 in which the changes to the gains in individual frequency channels of the noise reduction processing or in the individual frequency channels of the output modules are made slowly and over a time scale of at least 100 ms.

14. The sound processing device of claim 4 in which the operation of a user actuated control on the device is binaurally linked so that any change initiated by the control is applied to both ears substantially simultaneously in a coordinated manner.

15. The sound processing device of claim 4 in which the sound processing in the signal path of each ear is configured to have minimum delay, and to have substantially equal delay from input to output.

16. The sound processing device of claim 4 in which the wired or wireless communication link between the two devices is disabled when the signal-to-noise-ratio in each ear is greater than a configurable threshold value, and enabled when the signal-to-noise-ratio in either ear is below the configurable threshold.

17. The sound processing device of claim 4 where each ear is fitted with a cochlear implant or a hearing aid.

18. The sound processing device of claim 4 where the signal-to-noise ratio in each ear is estimated using the difference between a high percentile estimate and a low percentile estimate.

19. A computer program product comprising computer program code means stored in a non-transitory computer readable medium to make a computer execute a binaural noise reduction sound processing procedure, the computer program product comprising:

computer program means accepting at least one input signal comprising a digital representation of sound from at or near each ear of a listener;

computer program means for estimating from the digital representation of sound at each ear a signal-to-noise ratio present in the digital representation of the sound at each ear;

computer program means for comparing the signal-to-noise ratios present at the two ears and selecting the ear with the greater signal-to-noise ratio;

computer program means for using information from the signal of the selected ear to control two noise reduction processes respectively applied to the digital representations of the sound from the two ears to improve a signal to noise ratio of the digital representation, each noise reduction process using at least one noise reduction parameter which is determined based only on information present in the signal of the selected ear, whereby the information present in the signal of the selected ear is used as a basis for controlling the noise reduction processing to operate consistently in each ear; and computer program means for presenting the signals to each ear of the device user.

* * * * *